US005460666A

United States Patent [19]

Fujita et al.

[11] Patent Number: 5,460,666

[45] Date of Patent: Oct. 24, 1995

[54] METHOD OF MANUFACTURING NATURAL AGING-RETARDATED ALUMINUM ALLOY SHEET

[75] Inventors: Takeshi Fujita; Kohei Hasegawa; Shinji Mitao; Masataka Suga; Masakazu Niikura, all of Tokyo; Koichi Ohori, Mishima; Hiroshi Saitoh, Susono, all of Japan

[73] Assignees: NKK Corporation; Mitsubishi Aluminum Co., Ltd., both of Tokyo, Japan

[21] Appl. No.: 205,623

[22] Filed: Mar. 2, 1994

[30] Foreign Application Priority Data

Mar. 3, 1993 [JP] Japan ..... 5-043038

[51] Int. Cl.[6] ..... C22F 1/047

[52] U.S. Cl. ..... 148/693; 148/694; 148/417; 148/418; 148/439; 420/530

[58] Field of Search ..... 148/693, 439, 148/694, 417, 418; 420/530, 532, 534, 535, 536

[56] References Cited

U.S. PATENT DOCUMENTS

| | | | |
|---|---|---|---|
| 4,645,543 | 2/1987 | Watanabe et al. | 148/439 |
| 4,909,861 | 3/1990 | Muraoka et al. | 148/439 |
| 5,240,522 | 8/1993 | Tanaka et al. | 148/693 |

FOREIGN PATENT DOCUMENTS

| | | |
|---|---|---|
| 53-103914 | 9/1978 | Japan . |
| 57-120648 | 7/1982 | Japan . |
| 1-225738 | 9/1989 | Japan . |
| 2-47234 | 2/1990 | Japan . |
| 5-230604 | 9/1993 | Japan . |

OTHER PUBLICATIONS

Y. Komatsu; Development of All Aluminum Body for Automotive; Feb. 1991; pp. 42–48; JIDOSHA GIJYUTU (Automobile Technology), vol. 45, No. 6.

H. Yoshida; Properties of Aluminum Alloy Sheets for Auto Bodies, Jan. 1991; pp. 20–31; Report Of 31st Light Metal Annual Symposium; vol. 32, No. 1.

*Primary Examiner*—W. Gary Jones
*Assistant Examiner*—Sean Vincent
*Attorney, Agent, or Firm*—Frishauf, Holtz, Goodman, Langer & Chick

[57] ABSTRACT

A method manufacturing an aluminum alloy sheet comprising preparing an aluminum alloy ingot essentially consisting of 1.5 to 3.5% by weight of Mg, 0.3 to 1.0% by weight of Cu, 0.05 to 0.6% by weight of Si, and a balance of Al, in which the ratio of Mg/Cu is in the range of 2 to 7, homogenizing the ingot in one step or in multiple steps, performed at a temperature within a range of 400 to 580° C., preparing an alloy sheet having a desired sheet thickness by subjecting the ingot to a hot rolling and a cold rolling, subjecting the alloy sheet to heat treatment including heating the sheet up to a range of 500° to 580° C. at a heating rate of 3° C./sec. or more, keeping it for 0 to 60 seconds at the temperature reached, and cooling it to 100° C. or less at a looking rate of 2° C./sec. or more, and keeping the alloy sheet at a temperature within a range of 180° to 300° C. for 3 to 60 seconds. Thus, a natural aging-retardated aluminum alloy sheet is obtained.

6 Claims, 2 Drawing Sheets

METHOD OF MANUFACTURING NATURAL AGING-RETARDATED ALUMINUM ALLOY SHEET

BACKGROUND OF THE INVENTION

1. Field of the Invention

The present invention relates to a method of manufacturing an aluminum alloy sheet, more particularly, to a method of manufacturing an aluminum alloy sheet having excellent formability and excellent bake hardenability, having a natural aging retardation property, and suitable for use in an automobile body sheet.

2. Description of the Related Art

A conventional surface-treated cold-rolled steel sheet has frequently been used as a sheet material for an automobile body panel. In recent years, however, for an the purpose of reducing fuel consumption, a light-weight automobile body panel material has been demanded. To satisfy the demand, an aluminum alloy sheet has begun being used for the automobile body panel.

Nowadays, manufacturers in press forming of panel sheets are requesting that the material not only have low yield strength until being subjected to press forming so as to provide a satisfactory shape-retaining property [Jidosha Gijyutu (Automobile Technology), Vol. 45, No. 6 (1991), 45)], but also have a property such that strength thereof can be improved during paint baking to provide satisfactory formability of deep drawing and overhang, and dent resistance.

Under these circumstances, an attempt has been made in which the strength of the material was improved by adding Cu and Zn to a non-heat treated type, Al—Mg based alloy which has superior formability to other aluminum alloys. As a result, an Al—Mg—Cu alloy (Jpn. Pat. Appln. KOKAI Publication Nos. 57-120648, 1-225738), an Al—Mg—Cu—Zn alloy (Jpn. Pat. Appln. KOKAI Publication No. 53-103914), and the like have been developed. These alloy sheets are superior to an A—Mg—Si alloy sheet but inferior to a conventional surface-treated cold-rolled steel sheet in formability, and exhibit a poor shape-retaining property since the alloy sheets have high strength prior to being press formed. In addition, the degree of hardening obtained by paint baking is not sufficient, and the degree of hardening is low only to prevent a work hardening value obtained by press-forming from lowering. In Jpn. Pat. Appln. KOKAI Publication No. 57-120648, an attempt has been made to improve the strength at the time of the paint baking by precipitating an A—Cu—Mg compound; however, the results have not been satisfactory. Since the effect of Si in improving baking hardness was not yet discovered at the time the aforementioned application was made, Si was limited to a low level.

A conventional 5052-0 material is used in the automobile body panel. Although it exhibits a superior shape-retaining property owing to low yield strength prior to being subjected to press forming, 5052-0 is inferior in dent resistance since satisfactory hardness cannot be provided by paint baking.

The above mentioned bake hardened type alloys which are composed of Al—Mg and Cu or Cu and Zn have a common disadvantage in that the alloys exhibit a secular change in the strength prior to being subjected to press forming since natural aging starts right after the final heat treatment ["Report of 31th light metal annual symposium", Sumi-kei Giho (Sumitomo Light metal technology report), vol. 32, No. 1 (1991), 20, page 31)]. Therefore, it is necessary to control timing of the manufacturing raw material and heat treatment, and a period of time from the heat treatment to press forming.

One technique of suppressing the change in the strength with time by natural aging is provided by Jpn. Pat. Appln. KOKAI Publication No. 2-47234, which discloses that natural aging of the Al—Mg—Cu—Zn alloy is suppressed by reducing a content of Zn, which has a significant effect on natural aging.

Nevertheless, heretofore, there have been no alloys which provide satisfactory bake hardening, shape-retaining property, and natural aging retardation, even though they may have excellent formability relatively close to that of steel.

SUMMARY OF THE INVENTION

The present invention has been made in view of the above circumstances. An object of the present invention is to provide a manufacturing of an aluminum alloy sheet exhibiting excellent formability and excellent bake hardenability, and having an excellent natural aging retardation property.

According to the present invention, there is provided a method of manufacturing a natural aging-retardated aluminum alloy sheet, said method comprising the steps of:

preparing an aluminum alloy ingot essentially consisting of 1.5 to 3.5% by weight of Mg, 0.3 to 1.0% by weight of Cu, 0.05 to 0.6% by weight of Si, and a balance of Al, in which the ratio of Mg/Cu is in the range of 2 to 7;

homogenizing the ingot in one step or in multiple steps, performed at a temperature within a range of 400° to 580° C.;

preparing an alloy sheet having a desired sheet thickness by subjecting the ingot to a hot rolling and a cold rolling;

subjecting the alloy sheet to a heat treatment including heating the sheet up to a range of 500° to 580° C. at a heating rate of 3° C./second or more, keeping it for 0 to 60 seconds and at the temperature reached, and cooling it to 100° C. or less at a cooling rate of 2° C./sec. or more; and keeping the alloy sheet at a temperature within a range of 180° to 300° C. for 3 to 60 seconds.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
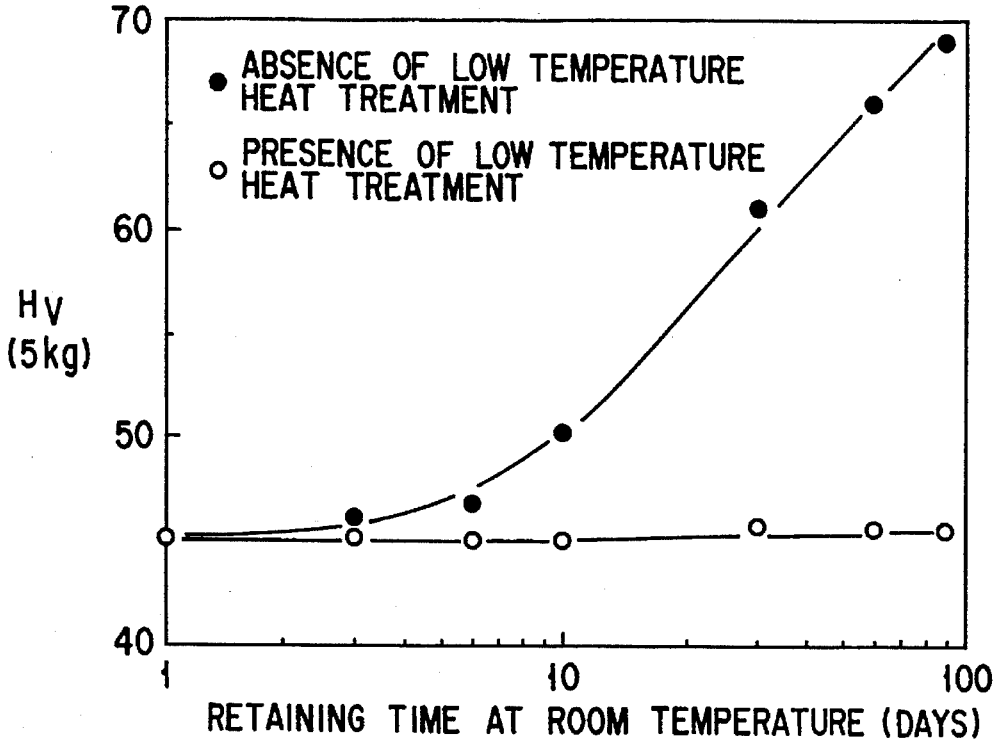
FIG. 1 is a graph showing the effect of a low temperature heat treatment on natural aging retardating property.

The present invention will now be explained in detail.

The present inventors have made intensive and extensive studies with a view toward attaining the above mentioned objects. As a result, they found that a natural aging of an aluminum alloy sheet can be retardated and maintaining excellent formability and bake hardenability, when Al—Mg—Cu alloy material containing Si of a specified composition is subjected to high temperature annealing for solution treatment, cooled to 100° C. or less at a cooling rate of 2° C./sec. or more, and kept at a comparatively low temperature of 180° to 300° C. for a short period of time. The present invention was made based on the finding of the present inventors and as a result of expensive studies of manufacturing conditions.

The present invention thus provides a method of manufacturing an aluminum alloy sheet comprising:

preparing an aluminum alloy ingot essentially consisting of 1.5 to 3.5% by weight of Mg, 0.3 to 1.0% by weight of Cu, 0.05 to 0.6% by weight of Si, and a balance of Al, in which the ratio of Mg/Cu is in the range of 2 to 7;

homogenizing the ingot in one step or in multiple steps, performed at a temperature within a range of 400° to 580° C.;

preparing an alloy sheet having a desired sheet thickness by subjecting the ingot to a hot rolling and a cold rolling;

subjecting the alloy sheet to a heat treatment including heating the sheet up to a range of 500° to 580° C. at a heating rate of 3° C./second or more, keeping it for 0 to 60 seconds at the temperature reached, and cooling to 100° C. or less at a cooling rate of 2° C./sec. or more; and keeping the alloy sheet at a temperature within a range of 180° to 300° C. for 3 to 60 seconds.

In view of retarding natural aging of the alloy, it is preferable that the alloy essentially consist of 1.5 to 3.5% by weight of Mg, 0.3 to 0.7% by weight of Cu, 0.05 to 0.35% by weight of Si, and the balance of Al, in which the ratio of Mg/Cu is in the range of 2 to 7.

Even if at least one additional element selected from the group consisting of 0.03 to 0.50% by weight of Fe, 0.005 to 0.15% by weight of Ti, 0.0002 to 0.05% by weight of B, 0.01 to 0.50% by weight of Mn, 0.01 to 0.15% by weight of Cr, 0.01 to 0.12% by weight of Zr, 0.01 to 0.18% by weight of v, and 0.5% or less by weight of Zn, is further added to the alloy the effect of the present invention would not be lessened, and an aluminum alloy sheet having further excellent properties can be obtained.

If at least one selected from the group consisting of 0.01 to 0.50% by weight of Sn, 0.01 to 0.50% by weight of Cd, and 0.01 to 0.50% by weight of In, in addition to the alloy, the natural aging can be retarded such that the effect of the natural aging is substantially absent.

The alloy composition of the present invention is based on an Al—Mg—Cu alloy containing Si, and excellent bake hardenability is given to the alloy by forming a modulated structure (GPB zone) appearing prior to precipitating a precipitation phase of Al—Cu—Mg compound in the alloy, thereby exhibiting excellent formability and excellent bake hardenability.

Hereinbelow, the reason why individual components are defined as described above will be explained. Each content is shown in the terms of weight percentages.

Mg: Mg is a constitutional element of the Al—Cu—Mg modulated structure of the present invention. At the Mg content of less than 1.5%, the generation of the modulated structure is retarded, and modulated structure cannot be generated, when the alloy sheet is subjected to baking at a temperature of 120° to 180° C. for a baking period of time from 5 to 40 minutes. Further, at the Mg content of less than 1.5%, ductility is lowered. On the other hand, when the content exceeds 3.5%, the generation of the modulated structure is also retarded, and no modulated structure is generated, when the alloy sheet is subjected to baking at a temperature in the range of 120° to 180° C. for a baking period of time from 5 to 40 minutes. Therefore, the Mg content is defined within a range of 1.5 to 3.5%.

Cu: Cu is a constitutional element of the Al—Cu—Mg modulated structure of the present invention. At the Cu content of less than 0.3%, the modulated structure cannot be generated. When the content exceeds 1.0%, corrosion resistance remarkably deteriorates. Therefore, the Cu content is defined within a range of 0.3 to 1.0%.

However, when the Cu content exceeds 0.7%, the Al—Cu—Mg modulated structure is generated even at ordinary temperature. As a result, the secular change in strength of the alloy generates. Therefore, the degree of bake hardenability is decreased. Moreover, corrosion resistance deteriorates to some extent. Hence, it is desirable that the Cu content is in a range of 0.3 to 0.7%, taking natural aging problem and corrosion resistance into consideration.

The ratio of Mg to Cu (Mg/Cu) is defined within the range of 2 to 7. Within the range, the modulated structure can be effectively generated.

Si: Si is an element which improves a hardenability by facilitating generation of the Al—Cu—Mg modulated structure and suppresses natural aging. To perform the function efficiently, it is necessary that the Si content is 0.05% or more. When the Si content exceeds 0.6%, the above mentioned modulated structure is generated, however, at the same time, a GP (1) modulated structure of $Mg_2Si$ is also generated. The GP (1) modulated structure facilitates natural aging which leads to remarkable increase with time in the strength of the sheets prior to being subjected to a baking treatment. As a result, the degree of bake hardening is reduced. Therefore, the Si content is defined within a range of 0.05 to 0.6%. To retard natural aging without generating the GP (1) modulated structure of $Mg_2Si$, it is desirable that the Si content is 0.35% or less.

Elements other than these above mentioned basic elements are also defined for the following reasons.

Fe: When Fe is present in a content of 0.50% or more, a coarse crystal is readily formed with the presence of Al, and also reduces the content of Si which is effective to form the modulated structure by binding to Si. However, since a small amount of Fe contributes to formability and the effect can be obtained when the amount is 0.03% or more. Therefore, the Fe content is defined within a range of 0.03% to 0.50%.

Ti, B: Ti and B are present in the form of $TiB_2$, which improves the workability during hot working by making crystal grains of the ingot fine. Therefore, it is important to add Ti together with B. However, an excess content of Ti and B facilitates generation of a coarse crystal thereby causing deterioration of the formability. Therefore, the contents of Ti and B are defined in the range such that the effect can be obtained efficiently, that is, the range of 0.005 to 0.15, and 0.0002 to 0.05%, respectively.

Mn, Cr, Zr, V: These elements are recrystallization suppressing elements. In order to suppress abnormal grain growth, these elements may be added in an appropriate amount. However, these elements have a negative effect on the equiaxial recrystallization of grains, thereby causing deterioration of the formability. Therefore, the content of these elements is defined as less than that contained in a conventional aluminum alloy. Hence, the contents of Mn, Cr, Zr, and V are defined within a range of 0.01 to 0.50%, 0.01 to 0.15%, 0.01 to 0.12%, and 0.01 to 0.18%, respectively.

Zn: Zn is an element which contributes to improving strength. However, the content in excess of 0.5% reduces the degree of baking hardening. To be more specific, in the Zn content exceeding 0.5%, a modulated structure, which is the stage prior to the precipitation of the Al—Zn compound, may be generated. The modulated structure, however, can be also generated at ordinary temperature and the strength of the alloy sheet prior to being subjected to baking, remarkably increases with time, thereby decreasing the degree of bake hardening. Therefore, it is necessary that the content of Zn should not be exceed 0.5%.

Si, In, Cd: These alloy elements are the atoms which strongly bind to frozen vacancies generated by a quenching treatment performed after a solution treatment. Therefore, the number of vacancies facilitates formation of the Al—Cu—Mg modulated structure, thereby retarding natural aging. However, when the content of each element is less than 0.01%, the effect of these elements is not obvious. In contrast, when the content exceeds 0.5%, the effect saturates, i.e., the effect is not produced in proportion to the content, thereby lowering cost performance.

Therefore, the content of Sn, In and Cd are defined within a range of 0.01 to 0.5%.

Besides the above mentioned elements, inevitable impurities are also contained in the aluminum alloy sheet as observed in a conventional one. The amount of the inevitable impurities is not limited as long as it does not ruin the effect of the present invention. For example, Be, Na and K at the level of 0.001% may not affect properties of the aluminum alloy.

An aluminum alloy whose components and composition are defined above is melted and casted to obtain an ingot by conventional procedure. The ingot is then subjected to a homogenization heat treatment at a temperature in the range of 400° to 580° C. in one step or in multiple steps, thereby facilitating a diffusion dissoluting of an eutectic compound crystallized at a casting process, and reducing local microsegregation. Further, the homogenizing treatment suppresses abnormal growth of crystal grains. As a result, fine grains of compounds of Mn, Cr, Zr, and V, which perform an important function in homogenizing the alloy, can be finely precipitated. However, when the homogenizing treatment is performed at a temperature less than 400° C., the above mentioned effect could not be sufficiently obtained. When the treatment is performed at a temperature above 580° C., an eutectic melting would be occur. Therefore, the temperature of the homogenizing treatment is defined in the range of 400° to 580° C. When the treatment is performed for the period of time less than one hour at a temperature in the range mentioned above, the effect could not be sufficiently obtained. On the other hand, when this treatment is performed over 72 hours, the effect is saturated. Hence, it is desirable that the reaction time is 1 to 72 hours.

An ingot completed with the homogenizing treatment is then subjected to a hot rolling and a cold rolling to obtain a sheet having a predetermined thickness by conventional procedure. In order to straighten or to adjust surface roughness, a 5% or less of leveling, stretching or skin pass rolling may be performed before or after, or before and after the following heat treatment.

After the rolling step, the rolled sheet is subjected to a heat treatment including heating the sheet up to a temperature within the range of 500° to 580° C. at a heating rate of 3° C./second or more; then keeping the sheet for at most 60 seconds at the temperature reached or not keeping; and rapidly cooling the sheet to 100° C. or less at a cooling rate of 2° C./sec. or more.

The heat treatment is performed in order to intend to dissolve Cu and Mg which are the constituents of the modulated structure mode of the Al—Cu—Mg compound to the alloy and to obtain the sufficient degree of bake hardening. In this case, when the heating treatment is performed less than 500° C., the above mentioned effect could not be sufficiently obtained. On the other hand, when the temperature exceeds 580° C.; when the heating rate is less than 3° C./second; or when the keeping time exceeds 60 seconds, abnormal grain growth would be readily occur in certain grains, thereby lowering formability. Further, it is not preferable that the cooling rate until 100° C. is less than 2° C./sec. in view of increasing bake hardening, since the Al—Cu—Mg compound is precipitated during the cooling step.

After the solution treatment, the alloy sheet is kept at 180° to 300° C. for 3 to 60 seconds.

This low temperature heat treatment is performed to suppress the formation of GPB zone of Al—Cu—Mg compound modulated structure. When the temperature of the treatment is less than 180° C. or the keeping time of the treatment is less than 3 seconds, the above mentioned effect could not be sufficiently obtained. On the other hand, when the temperature of the treatment is more than 300° C. or the keeping time of the treatment is more than 60 seconds, a larger Al—Cu—Mg compound is precipitated, thereby reducing bake hardenability and increasing concentration of vacancies.

FIG. 1 is a graph showing the effect of the low temperature heat treatment on natural aging property after the solution treatment. As apparent from FIG. 1, natural aging can be almost eliminated by the low temperature heating.

In addition to the above steps, it is preferable to perform an intermediate annealing treatment including heating the sheet at a temperature in a range of 500° to 580° C. at a heating rate of 3° C./second or more; keeping the sheet for at most 60 seconds at the temperature reached or not keeping; and cooling the sheet to 100° C. at a cooling rate of 2° C./seconds, after rolling the ingot up to the intermediate thickness, and to perform a cold reduction of 5 to 45%.

By virtue of the additional steps mentioned above, the formation of the modulated structure is accelerated, thereby increasing the bake hardenability.

Figure 2:
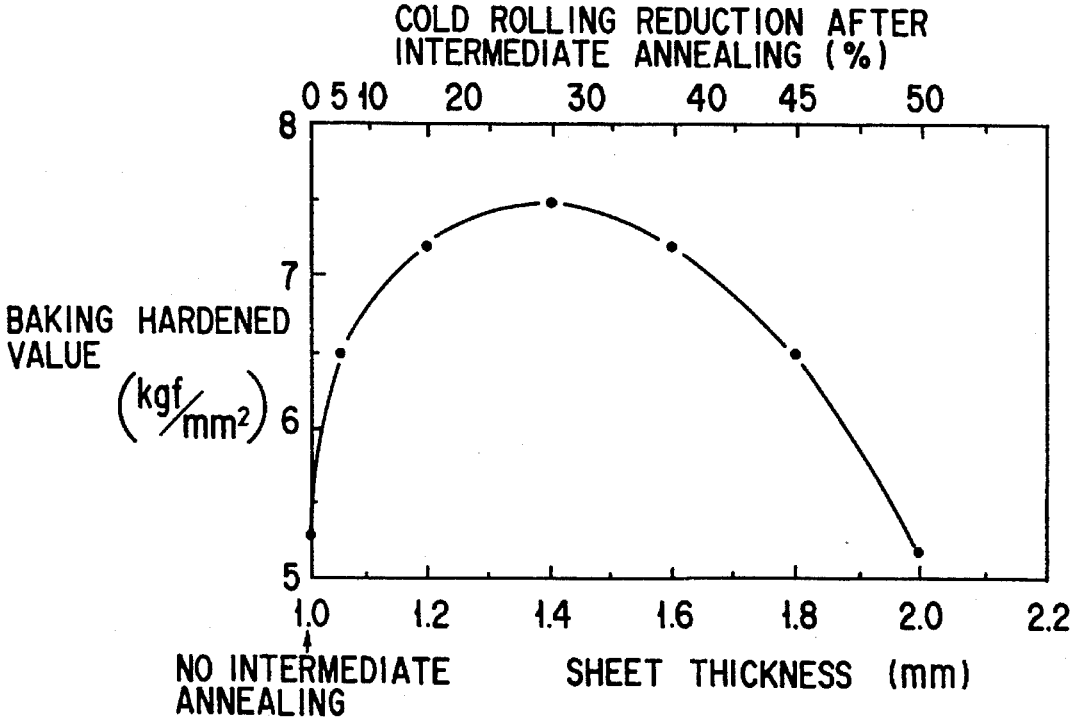
FIG. 2 is a graph showing the effect of rolling reduction after intermediate annealing on an amount of bake hardening.

FIG. 2 shows the relationship between the intermediate thickness (the cold rolling reduction after intermediate annealing) of the sheet to be subjected to an intermediate annealing treatment and the degree of bake hardening (the value obtained by subtracting the yield strength before baking from that of after baking). The thicknesses of the final sheet were of constant values of 1.0 mm.

As apparent from FIG. 2, when the intermediate annealing treatment is performed in the intermediate thickness such that the rolling reduction of the final rolling step is 5 to 45%, the degree of bake hardening can be as high as 7 kg/mm$^2$.

When the rolling reduction of the final rolling step is less than 5%, the formability may deteriorate since the generation of the modulated structure of the Al—Cu—Mg compound may not be facilitated and the baking hardenability of the alloy sheet may be lowered due to an abnormal grain growth. When the rolling reduction of the final rolling step is more than 45%, the Al—Cu—Mg compound is ununiformly precipitated and the baking hardenability of the alloy sheet may be lowered.

The intermediate annealing condition is the same as that used in the heat treatment following the rolling step. When the heating rate and the cooling rate are below the minimum value, a larger Al—Mg—Cu compound may be precipitated, thereby reducing baking hardenability.

Since the aluminum alloy sheet thus obtained exhibits excellent press formability and excellent paint bake hardenability and has natural aging retardation property, the aluminum alloy sheet is suitable for use in an automobile body sheet.

EXAMPLES

Hereinafter the Examples of the present invention will be described.

Example 1

An alloy comprising the components in the contents shown in Tables 1 and 2, was melted, and continuously casted to form ingots. The obtained ingots were subjected to facing. The ingots were subjected to a 2-step homogenization heat treatment, first for 4 hours at 440° C., and second, for 10 hours at 510° C. Then, the ingots were heated to 460° C. and subjected to a hot-rolling to form sheets having thickness of 4 mm. After being cooled at room temperature, the above obtained sheets were subjected to a cold-rolling to obtain sheets having a thickness of 1.4 mm, followed by performing an intermediate annealing treatment which includes heating up to 550°·C. at a heating rate of 3° C./second; keeping the sheets for 10 seconds at 550° C.; and air-cooling compulsorily to 100° C. at a cooling rate of 20° C./second.

After the sheets were cooled to room temperature, the sheets were subjected to a cold rolling to form the final sheets having a thickness of 1 mm. Note that, the finish temperature of the hot rolling treatment was 280° C.

The above obtained sheets of 1 mm in thickness were heated to 550° C. at a heating rate of 10° C./sec., kept for 10 seconds, and cooled compulsorily to 100° C. at a cooling rate of 20° C./sec.

After the heat treatment, the sheets were subjected to a low temperature stabilizing treatment at 240° C. for 10 sec.

After the sheets thus obtained were kept for one day and 90 days at room temperature, the sheets were cut off in the predetermined shapes to conduct a tensile test (a stretched direction: a rolled direction) according to methods described in the Japanese Industrial Standard (JIS) No. 5, and to conduct a conical cup test according to JIS Z2249 (using test tool 17 type), thereby evaluating mechanical properties and formability. A conical cup value (CCV) denotes the complex formability of overhang and deep drawing. The smaller the CCV is, the better the formability obtained.

In order to simulate paint baking following press forming, a heat treatment was carried out at 170° C. for 20 minutes. This treatment corresponds to an actual baking step. Again, the tensile test was performed in substantially the same condition as in the above.

These test results are shown in Tables 3 and 4. The value of the column "bake hardening" is obtained by subtracting yield strength after the final heat treatment from that after the heat treatment simulating the actual baking step. Alloys Nos. 1 to 16 of Table 1 are examples of the compositions of which are within the range of the present invention. On the contrary, the alloys Nos. 17 to 33 of Table 2 are comparative examples of the compositions of which are out of the range of the present invention.

It should be noted that Nos. 31, 32, and 33 are alloys conventionally used for automobile body panels and correspond to 2036 alloy, 5182 alloy, and 6010 alloy, respectively.

TABLE 1

| Alloy | Chemical composition (wt %) | | | | | | | | | | | | | |
|---|---|---|---|---|---|---|---|---|---|---|---|---|---|---|
| number | Mg | Si | Cu | Fe | Ti | B | Zn | Mn | Cr | Zr | V | Sn | In | Cd |
| 1 | 2.1 | 0.29 | 0.60 | 0.14 | 0.018 | 0.0017 | 0.13 | <0.01 | <0.01 | <0.01 | <0.01 | <0.01 | <0.01 | <0.01 |
| 2 | 1.6 | 0.34 | 0.50 | 0.14 | 0.015 | 0.0016 | 0.20 | <0.01 | <0.01 | <0.01 | <0.01 | <0.01 | <0.01 | <0.01 |
| 3 | 3.3 | 0.31 | 0.56 | 0.12 | 0.011 | 0.0011 | 0.09 | <0.01 | <0.01 | <0.01 | <0.01 | <0.01 | <0.01 | <0.01 |
| 4 | 2.0 | 0.09 | 0.61 | 0.17 | 0.009 | 0.0008 | 0.12 | <0.01 | <0.01 | <0.01 | <0.01 | <0.01 | <0.01 | <0.01 |
| 5 | 2.4 | 0.55 | 0.40 | 0.09 | 0.010 | 0.0011 | 0.07 | <0.01 | <0.01 | <0.01 | <0.01 | <0.01 | <0.01 | <0.01 |
| 6 | 2.1 | 0.26 | 0.35 | 0.15 | 0.013 | 0.0012 | 0.16 | <0.01 | <0.01 | <0.01 | <0.01 | <0.01 | <0.01 | <0.01 |
| 7 | 1.9 | 0.28 | 0.90 | 0.10 | 0.020 | 0.0019 | 0.08 | <0.01 | <0.01 | <0.01 | <0.01 | <0.01 | <0.01 | <0.01 |
| 8 | 2.0 | 0.30 | 0.62 | 0.42 | 0.019 | 0.0017 | 0.11 | <0.01 | <0.01 | <0.01 | <0.01 | <0.01 | <0.01 | <0.01 |
| 9 | 2.2 | 0.33 | 0.59 | 0.13 | 0.120 | 0.0460 | 0.14 | <0.01 | <0.01 | <0.01 | <0.01 | <0.01 | <0.01 | <0.01 |
| 10 | 1.8 | 0.27 | 0.66 | 0.09 | 0.018 | 0.0018 | 0.40 | <0.01 | <0.01 | <0.01 | <0.01 | <0.01 | <0.01 | <0.01 |
| 11 | 2.3 | 0.30 | 0.46 | 0.12 | 0.019 | 0.0018 | 0.09 | 0.43 | <0.01 | <0.01 | <0.01 | <0.01 | <0.01 | <0.01 |
| 12 | 2.2 | 0.30 | 0.58 | 0.10 | 0.016 | 0.0014 | 0.12 | <0.01 | 0.13 | <0.01 | <0.01 | <0.01 | <0.01 | <0.01 |
| 13 | 2.0 | 0.29 | 0.59 | 0.09 | 0.014 | 0.0011 | 0.10 | <0.01 | <0.01 | 0.10 | <0.01 | <0.01 | <0.01 | <0.01 |
| 14 | 2.0 | 0.32 | 0.61 | 0.11 | 0.018 | 0.0017 | 0.10 | <0.01 | <0.01 | <0.01 | 0.16 | <0.01 | <0.01 | <0.01 |
| 15 | 2.3 | 0.32 | 0.50 | 0.10 | 0.019 | 0.0018 | 0.08 | <0.01 | <0.01 | <0.01 | <0.01 | 0.42 | <0.01 | <0.01 |
| 16 | 2.0 | 0.30 | 0.62 | 0.12 | 0.016 | 0.0014 | 0.12 | <0.01 | <0.01 | <0.01 | <0.01 | <0.01 | 0.39 | 0.41 |

TABLE 2

| Alloy number | Chemical composition (wt %) | | | | | | | | | | | | | |
|---|---|---|---|---|---|---|---|---|---|---|---|---|---|---|
| | Mg | Si | Cu | Fe | Ti | B | Zn | Mn | Cr | Zr | V | Sn | In | Cd |
| 17 | 1.2 | 0.30 | 0.59 | 0.12 | 0.019 | 0.0017 | 0.12 | <0.01 | <0.01 | <0.01 | <0.01 | <0.01 | <0.01 | <0.01 |
| 18 | 3.9 | 0.29 | 0.48 | 0.10 | 0.019 | 0.0018 | 0.09 | <0.01 | <0.01 | <0.01 | <0.01 | <0.01 | <0.01 | <0.01 |
| 19 | 2.1 | 0.01 | 0.61 | 0.11 | 0.010 | 0.0008 | 0.10 | <0.01 | <0.01 | <0.01 | <0.01 | <0.01 | <0.01 | <0.01 |
| 20 | 2.0 | 0.71 | 0.60 | 0.14 | 0.014 | 0.0013 | 0.11 | <0.01 | <0.01 | <0.01 | <0.01 | <0.01 | <0.01 | <0.01 |
| 21 | 1.8 | 0.32 | 0.21 | 0.10 | 0.018 | 0.0017 | 0.18 | <0.01 | <0.01 | <0.01 | <0.01 | <0.01 | <0.01 | <0.01 |
| 22 | 2.0 | 0.28 | 1.12 | 0.13 | 0.021 | 0.0019 | 0.20 | <0.01 | <0.01 | <0.01 | <0.01 | <0.01 | <0.01 | <0.01 |
| 23 | 2.3 | 0.30 | 0.58 | 0.65 | 0.020 | 0,0020 | 0.13 | <0.01 | <0.01 | <0.01 | <0.01 | <0.01 | <0.01 | <0.01 |
| 24 | 1.9 | 0.29 | 0.55 | 0.12 | 0.190 | 0.0620 | 0.13 | <0.01 | <0.01 | <0.01 | <0.01 | <0.01 | <0.01 | <0.01 |
| 25 | 1.9 | 0.32 | 0.58 | 0.12 | 0.017 | 0.0015 | 0.70 | <0.01 | <0.01 | <0.01 | <0.01 | <0.01 | <0.01 | <0.01 |
| 26 | 2.1 | 0.31 | 0.63 | 0.17 | 0.009 | 0.0008 | 0.17 | 0.63 | <0.01 | <0.01 | <0.01 | <0.01 | <0.01 | <0.01 |
| 27 | 2.0 | 0.24 | 0.55 | 0.13 | 0.015 | 0.0014 | 0.12 | <0.01 | 0.20 | <0.01 | <0.01 | <0.01 | <0.01 | <0.01 |
| 28 | 2.4 | 0.28 | 0.60 | 0.10 | 0.016 | 0.0014 | 0.17 | <0.01 | <0.01 | 0.20 | <0.01 | <0.01 | <0.01 | <0.01 |
| 29 | 2.1 | 0.31 | 0.61 | 0.12 | 0.011 | 0.0009 | 0.14 | <0.01 | <0.01 | <0.01 | 0.22 | <0.01 | <0.01 | <0.01 |
| 30 | 3.4 | 0.30 | 0.42 | 0.14 | 0.013 | 0.0012 | 0.09 | <0.01 | <0.01 | <0.01 | <0.01 | 0.11 | <0.01 | <0.01 |
| 31 | 0.4 | 0.47 | 2.4 | 0.37 | 0.021 | 0.0008 | 0.08 | 0.21 | 0.06 | 0.02 | 0.02 | <0.01 | <0.01 | <0.01 |
| 32 | 4.4 | 0.40 | 0.1 | 0.35 | 0.15 | 0.0009 | 0.25 | 0.35 | 0.16 | <0.01 | <0.01 | <0.01 | <0.01 | <0.01 |
| 33 | 0.7 | 0.84 | 0.4 | 0.11 | 0.027 | 0.0009 | 0.24 | 0.191 | 0.14 | <0.01 | <0.01 | <0.01 | <0.01 | <0.01 |

TABLE 3

| Alloy number | Property after one day aging at room temperature | Properties after 90 days aging at room temperature | | | | | |
|---|---|---|---|---|---|---|---|
| | | Properties after heat treatment | | | Properties after baking | | |
| | Yield strength (kgf/mm$^2$) | Yield strength (kgf/mm$^2$) | Tensile strength (kgf/mm$^2$) | Elongation (%) | CCV (mm) | Yield strength (kgf/mm$^2$) | *Bake hardening (kgf/mm$^2$) |
| 1 | 7.5 | 7.8 | 21.5 | 32.8 | 39.9 | 15.2 | 7.4 |
| 2 | 6.5 | 6.6 | 20.3 | 31.0 | 40.1 | 13.2 | 6.6 |
| 3 | 8.8 | 9.0 | 22.4 | 34.4 | 39.8 | 15.5 | 6.5 |
| 4 | 7.2 | 7.3 | 21.0 | 33.3 | 39.9 | 14.0 | 6.7 |
| 5 | 8.0 | 8.2 | 21.5 | 31.2 | 40.1 | 14.8 | 6.6 |
| 6 | 6.5 | 7.0 | 20.4 | 33.0 | 39.9 | 14.1 | 7.1 |
| 7 | 8.9 | 9.4 | 23.2 | 32.1 | 40.0 | 16.6 | 7.2 |
| 8 | 7.8 | 8.0 | 21.5 | 31.0 | 40.1 | 14.6 | 6.6 |
| 9 | 7.8 | 8.2 | 22.2 | 30.8 | 40.1 | 15.2 | 7.0 |
| 10 | 8.2 | 8.4 | 22.2 | 32.5 | 40.0 | 15.0 | 6.6 |
| 11 | 7.6 | 7.9 | 21.2 | 31.5 | 40.1 | 14.7 | 6.8 |
| 12 | 7.8 | 8.1 | 22.0 | 30.8 | 40.1 | 15.0 | 6.9 |
| 13 | 8.2 | 8.3 | 21.8 | 31.0 | 40.1 | 14.4 | 6.1 |
| 14 | 7.7 | 8.1 | 21.4 | 31.4 | 40.1 | 15.2 | 7.1 |
| 15 | 9.8 | 8.0 | 21.5 | 32.2 | 40.0 | 14.8 | 6.8 |
| 16 | 7.4 | 7.6 | 21.1 | 32.5 | 40.0 | 14.7 | 7.1 |

*(yield strength after baking) — (yield strength after heat treatment)

TABLE 4

| Alloy number | Property after one day aging at room temperature | Properties after 90 days aging at room temperature | | | | | |
|---|---|---|---|---|---|---|---|
| | | Properties after heat treatment | | | Properties after baking | | |
| | Yield strength (kgf/mm$^2$) | Yield strength (kgf/mm$^2$) | Tensile strength (kgf/mm$^2$) | Elongation (%) | CCV (mm) | Yield strength (kgf/mm$^2$) | *Bake hardening (kgf/mm$^2$) |
| 17 | 5.8 | 6.3 | 19.7 | 27.8 | 40.5 | 10.0 | 3.7 |
| 18 | 8.9 | 9.4 | 23.2 | 34.0 | 39.8 | 12.9 | 3.5 |
| 19 | 7.1 | 7.4 | 21.0 | 32.9 | 40.0 | 11.3 | 3.9 |
| 20 | 8.3 | 13.6 | 26.3 | 22.9 | 41.0 | 13.7 | 0.1 |
| 21 | 6.3 | 6.8 | 20.1 | 32.8 | 39.9 | 10.1 | 3.3 |
| 22 | 9.7 | 14.6 | 26.9 | 23.8 | 40.9 | 15.2 | 0.6 |
| 23 | 8.1 | 9.0 | 22.8 | 28.5 | 40.4 | 11.3 | 2.3 |
| 24 | 8.6 | 9.4 | 22.7 | 28.6 | 40.4 | 11.3 | 1.9 |
| 25 | 8.5 | 13.5 | 26.8 | 22.2 | 41.1 | 13.7 | 0.2 |
| 26 | 7.9 | 8.5 | 22.1 | 27.2 | 40.5 | 11.3 | 2.8 |
| 27 | 8.4 | 9.4 | 22.9 | 26.7 | 40.6 | 12.3 | 2.9 |
| 28 | 8.2 | 9.1 | 23.1 | 27.2 | 40.6 | 11.5 | 2.4 |

TABLE 4-continued

| Alloy number | Property after one day aging at room temperature Yield strength (kgf/mm²) | Properties after 90 days aging at room temperature: Properties after heat treatment Yield strength (kgf/mm²) | Tensile strength (kgf/mm²) | Elongation (%) | CCV (mm) | Properties after baking Yield strength (kgf/mm²) | *Bake hardening (kgf/mm²) |
|---|---|---|---|---|---|---|---|
| 29 | 8.0 | 8.9 | 22.9 | 26.9 | 40.6 | 11.5 | 2.6 |
| 30 | 7.2 | 7.7 | 21.3 | 33.2 | 39.9 | 11.1 | 3.4 |
| 31 | 23.4 | 23.7 | 37.2 | 24.8 | 40.9 | 18.9 | −4.8 |
| 32 | 13.3 | 13.3 | 28.1 | 26.0 | 40.8 | 12.8 | −0.5 |
| 33 | 14.7 | 15.2 | 28.0 | 26.0 | 40.8 | 16.8 | 1.6 |

*(yield strength after baking) — (yield strength after heat treatment)

AS shown in Table 3, alloy sheets Nos. 1 to 16 show 30% or more of elongation and a satisfactory CCV value, thereby demonstrating that excellent formability was obtained. Further it was confirmed that the alloys possessed the value of bake hardening as high as 6.5 kgf/mm² of more in the terms of yield strength by baking treatment, and that the alloy sheets had excellent balance of elongation and strength.

On the other hand, as shown in Table 4 alloy sheets Nos. 17 to 33 shown in Table 2 possessed unsatisfactory values either in formability, in bake hardenability, or in natural aging retardating property. More specifically, in alloy sheets No. 17, 19, and 21, which contained Mg, Si, and Cu contributing to bake hardening in a small amount, as well as in alloy sheets No. 18, which contained Mg, in a large amount, the value of bake hardening thereof was at most 4 kgf/mm².

Alloy sheets Nos. 20, 22, and 25 which contained any of Si, Cu and Zn in a large amount, the value of bake hardening thereof was as low as about 0.6 kgf/mm². Alloy sheets No. 23, 24, 26, 27, 28, and 29, which contained any of Fe, Ti—B, Mn, Cr, Zr, and V out of the range of the present invention, showed lower formability.

Alloy sheet No. 30, whose ratio of Mg/Cu did not satisfy the range of 2 to 7, showed the value of bake hardening of 3.4 kgf/mm². It should be noted that conventional materials of Nos. 31 to 33 had low formability and low bake hardenability, and Nos. 31 and 32 were softened by baking.

Example 2

Alloy sheets were manufactured in substantially the same condition as in Example 1 using chemical compositions Nos. 1' to 30', which corresponded to Nos. 1 to 30 shown in Tables 1 and 2 except that the intermediate annealing was not performed. Substantially the same tests as in Example 1 were conducted. The results are shown in Tables 5 and 6.

TABLE 5

| Alloy number | Property after one day aging at room temperature Yield strength (kgf/mm²) | Properties after 90 days aging at room temperature: Properties after heat treatment Yield strength (kgf/mm²) | Tensile strength (kgf/mm²) | Elongation (%) | CCV (mm) | Properties after baking Yield strength (kgf/mm²) | *Bake hardening (kgf/mm²) |
|---|---|---|---|---|---|---|---|
| 1' | 8.2 | 8.4 | 21.7 | 32.9 | 39.9 | 14.3 | 5.9 |
| 2' | 7.2 | 7.5 | 20.7 | 30.7 | 40.1 | 12.8 | 5.3 |
| 3' | 9.4 | 9.6 | 22.7 | 33.8 | 39.8 | 14.8 | 5.2 |
| 4' | 7.8 | 7.9 | 21.3 | 33.8 | 39.9 | 13.3 | 5.4 |
| 5' | 8.5 | 8.8 | 22.1 | 31.1 | 40.1 | 14.2 | 5.4 |
| 6' | 7.3 | 7.5 | 20.9 | 32.5 | 39.9 | 13.0 | 5.5 |
| 7' | 9.6 | 9.8 | 23.5 | 32.0 | 40.0 | 15.4 | 5.6 |
| 8' | 8.5 | 8.7 | 22.2 | 30.7 | 40.2 | 13.9 | 5.2 |
| 9' | 8.6 | 8.9 | 22.4 | 30.6 | 40.2 | 14.3 | 5.4 |
| 10' | 8.9 | 9.1 | 22.4 | 32.5 | 40.0 | 14.5 | 5.4 |
| 11' | 8.3 | 8.6 | 21.8 | 31.3 | 40.1 | 13.9 | 5.3 |
| 12' | 8.5 | 8.7 | 22.3 | 30.8 | 40.2 | 14.2 | 5.5 |
| 13' | 8.7 | 8.8 | 22.3 | 30.7 | 40.2 | 14.2 | 5.4 |
| 14' | 8.5 | 8.6 | 22.2 | 31.3 | 40.1 | 14.3 | 5.7 |
| 15' | 8.4 | 8.6 | 22.3 | 31.9 | 40.0 | 14.0 | 5.4 |
| 16' | 8.1 | 8.3 | 21.6 | 31.9 | 40.0 | 13.9 | 5.6 |

*(yield strength after baking) — (yield strength after heat treatment)

TABLE 6

| Alloy number | Property after one day aging at room temperature Yield strength (kgf/mm²) | Properties after 90 days aging at room temperature: Properties after heat treatment Yield strength (kgf/mm²) | Tensile strength (kgf/mm²) | Elongation (%) | Properties after baking CCV (mm) | Yield strength (kgf/mm²) | *Bake hardening (kgf/mm²) |
|---|---|---|---|---|---|---|---|
| 17' | 6.3 | 6.6 | 20.1 | 27.8 | 40.5 | 9.8 | 3.2 |
| 18' | 9.8 | 9.8 | 23.1 | 33.7 | 39.8 | 12.6 | 2.8 |
| 19' | 7.6 | 7.7 | 21.1 | 32.9 | 39.9 | 11.1 | 3.4 |
| 20' | 9.1 | 13.5 | 26.5 | 23.2 | 41.0 | 13.5 | 0 |
| 21' | 6.9 | 7.3 | 20.5 | 32.6 | 39.9 | 9.8 | 2.5 |
| 22' | 10.8 | 15.0 | 26.7 | 24.0 | 40.9 | 15.5 | 0.5 |
| 23' | 8.8 | 9.2 | 23.0 | 28.4 | 40.4 | 10.8 | 1.6 |
| 24' | 9.2 | 9.5 | 22.9 | 28.6 | 40.4 | 11.1 | 1.6 |
| 25' | 9.6 | 13.7 | 26.9 | 21.8 | 41.1 | 13.7 | 0 |
| 26' | 8.6 | 8.9 | 22.5 | 27.0 | 40.6 | 10.9 | 2.0 |
| 27' | 9.2 | 9.6 | 23.2 | 26.1 | 40.7 | 11.7 | 2.1 |
| 28' | 9.1 | 9.4 | 23.3 | 26.8 | 40.6 | 11.3 | 1.9 |
| 29' | 8.7 | 9.2 | 23.0 | 26.3 | 40.6 | 11.2 | 2.0 |
| 30' | 7.7 | 7.9 | 21.2 | 33.2 | 39.9 | 10.8 | 2.9 |

*(yield strength after baking) — (yield strength after heat treatment)

As shown in Table 5, alloy sheets Nos. 1' to 16' show 30% or more of elongation as observed alloys Nos. 1 to 16 of Example 1. It was confirmed that the alloys showed values of bake hardening as high as 5.2 kg/mm² or more in the terms of yield strength although the values were lower than those of the alloy sheets manufactured by a process including intermediate annealing.

It was also confirmed that the value of the bake hardening of Nos. 17' to 30' was lower than that of Nos. 17 to 30, as shown in Table 6.

Example 3

Alloy sheets were manufactured using an ingot having a chemical composition corresponding to No. 1 shown in Table 1 in the condition shown in Table 7. With respect to treatments, e.g., rolling conditions and the like which are not described in Table 7, substantially the same treatments as in Example 1 were employed. The manufacturing conditions, A to G in Table 7 are within the range of the present invention, but H to R are not.

With respect to the thus manufactured alloy sheets, evaluation tests were conducted in substantially the same manner as in Example 1. The results are also shown in Table 7.

TABLE 7

| | Manufacturing conditions: Homogenization condition (°C. × hour) | Cold reduction rate after intermediate annealing (%) | Heat treatment conditions: Heating rate (°C./sec.) | Keeping (°C. × sec.) | Cooling rate (°C./sec.) | Low temperature heat treatment conditions: Heating temperature (°C.) | Keeping time (sec.) |
|---|---|---|---|---|---|---|---|
| Present invention | | | | | | | |
| A | 440 × 4 + 510 × 10 | 28.6 | 10 | 550 × 10 | 20 | 240 | 10 |
| B | " | " | 3 | 550 × 10 | " | " | " |
| C | " | " | 10 | 500 × 10 | " | " | " |
| D | 500 × 16 | 16.7 | " | 550 × 10 | " | " | " |
| E | 440 × 4 + 510 × 10 | 28.6 | " | " | 3 | " | " |
| F | " | " | " | " | 20 | 190 | 5 |
| G | " | " | " | " | " | 290 | 50 |
| Comparative example | | | | | | | |
| H | 600 × 10 | 28.6 | 10 | 550 × 10 | 20 | 240 | 10 |
| I | 440 × 4 + 510 × 10 | 3.84 | " | " | " | " | " |

TABLE 7-continued

| | | | | | | | |
|---|---|---|---|---|---|---|---|
| J | 440 × 4 + 510 × 10 | 54.5 | 10 | 550 × 10 | 20 | 240 | 10 |
| K | " | 28.6 | 1 | " | " | " | " |
| L | " | " | 10 | 600 × 10 | " | " | " |
| M | " | " | " | 480 × 10 | " | " | " |
| N | " | " | " | 550 × 10 | 1 | " | " |
| O | " | " | " | " | 10 | 150 | " |
| P | " | " | " | " | " | 240 | 1 |
| Q | | " | " | " | " | 320 | 10 |
| R | | " | " | " | " | 240 | 75 |

| | Property after one day aging at room temperature | Properties after 90 days aging at room temperature | | | | | |
|---|---|---|---|---|---|---|---|
| | | Properties after heat treatment | | | | Properties after baking | |
| | Yield strength (kgf/mm²) | Yield strength (kgf/mm²) | Tensile strength (kgf/mm²) | Elongation (%) | CCV (mm) | Yield strength (kgf/mm²) | *Bake hardening (kgf/mm²) |
| Present invention | | | | | | | |
| A | 7.5 | 7.8 | 21.5 | 32.8 | 39.9 | 15.2 | 7.4 |
| B | 7.8 | 7.9 | 21.4 | 32.4 | 40.0 | 14.6 | 6.7 |
| C | 7.8 | 8.0 | 21.6 | 32.5 | 40.0 | 14.5 | 6.5 |
| D | 7.4 | 7.6 | 21.2 | 32.2 | 40.0 | 14.6 | 7.0 |
| E | 8.1 | 8.4 | 21.8 | 32.0 | 40.0 | 14.9 | 6.5 |
| F | 7.5 | 8.0 | 21.5 | 32.8 | 39.9 | 15.2 | 7.2 |
| G | 8.0 | 8.1 | 21.8 | 33.0 | 39.9 | 14.6 | 6.5 |
| Comparative example | | | | | | | |
| H | 6.1 | 6.2 | 19.5 | 21.3 | 41.2 | 8.4 | 2.2 |
| I | 7.2 | 7.3 | 21.0 | 21.2 | 41.2 | 12.7 | 5.4 |
| J | 7.5 | 7.7 | 21.2 | 32.9 | 39.9 | 10.5 | 2.8 |
| K | 5.5 | 5.6 | 19.3 | 16.7 | 41.7 | 8.9 | 3.3 |
| L | 5.3 | 5.5 | 18.9 | 15.1 | 41.9 | 8.6 | 3.1 |
| M | 7.4 | 7.6 | 21.1 | 23.4 | 41.0 | 10.3 | 2.7 |
| N | 7.8 | 8.0 | 21.5 | 30.7 | 40.2 | 10.1 | 2.1 |
| O | 7.5 | 10.7 | 24.5 | 26.1 | 40.9 | 13.1 | 2.4 |
| P | 7.4 | 11.0 | 24.9 | 25.0 | 41.0 | 13.0 | 2.0 |
| Q | 8.6 | 8.6 | 22.2 | 26.5 | 40.9 | 10.3 | 1.7 |
| R | 8.2 | 8.3 | 22.0 | 26.0 | 40.9 | 10.2 | 1.9 |

As shown in Table 7, the alloy sheets manufactured according to the conditions of H to R showed unsatisfactory results of elongation and formability, or bake hardenability.

When homogenizing temperature or heat treatment temperature was high, the rolling reduction of the cold rolling following the intermediate annealing was low or the heating rate of the heating treatment was low as in Comparative Examples H, L, I, and K, abnormal grain growth occurred, with the result that the elongation and formability deteriorated.

When the rate of the cold reduction following the intermediate annealing was high, as in the case of J, when a cooling rate at the time of a solution treatment was low, as in the case of N, and when keeping temperature of solution treatment was low, as in the case of M, formability deteriorated because the alloy sheets were low in elongation and bake hardenabilities of these alloy sheets were insufficient. Further, when the temperature of low temperature heat treatment was low, as in the case of O, and when the keeping time thereof was short, as in the case of P, room temperature retaining properties (natural aging retardating properties) of the sheets deteriorated.

When the temperature of the low temperature heat treatment was high, as in the case of Q, and when the keeping time thereof was long, as in the case of R, sufficient bake hardenability could not obtained.

Example 4

Alloy sheets were manufactured using an ingot having a chemical composition corresponding to No. 1 of Table 1 in substantially the same condition as A to L of Example 3 except that the intermediate annealing treatment was not performed. With respect to the thus obtained alloy sheets evaluation tests were conducted in substantially the same manner as in Example 3. The results are shown in Table 8. A' to R' in Table 5 correspond to A to R in Example 3.

TABLE 8

| | Manufacturing conditions | | | | | |
|---|---|---|---|---|---|---|
| | Homogenization condition (°C. × hour) | Heat treatment conditions | | | Low temperature heat treatment conditions | |
| | | Heating rate (°C./sec.) | Keeping (°C. × sec.) | Cooling rate (°C./sec.) | Heating temperature (°C.) | Keeping time (sec.) |
| Present invention | | | | | | |
| A' | 440 × 4 + 510 × 10 | 10 | 550 × 10 | 20 | 240 | 10 |
| B' | " | 3 | 550 × 10 | " | " | " |
| C' | " | 10 | 500 × 10 | " | " | " |
| D' | 500 × 16 | " | 550 × 10 | " | " | " |
| E' | 440 × 4 + 510 × 10 | " | " | 3 | " | " |
| F' | " | " | " | 20 | 190 | 5 |
| G' | " | " | " | " | 290 | 50 |
| Comparative example | | | | | | |
| H' | 600 × 10 | 10 | 550 × 10 | 20 | 240 | 10 |
| K' | 440 × 4 + 510 × 10 | 1 | " | " | " | " |
| L' | " | 10 | 600 × 10 | " | " | " |
| M' | " | " | 480 × 10 | " | " | " |
| N' | " | " | 550 × 10 | 1 | " | " |
| O' | " | " | " | 10 | 150 | " |
| P' | " | " | " | " | 240 | 1 |
| Q' | " | " | " | " | 320 | 10 |
| R' | " | " | " | " | 240 | 75 |

| | Property after one day aging at room temperature | Properties after 90 days aging at room temperature | | | | | |
|---|---|---|---|---|---|---|---|
| | | Properties after heat treatment | | | | Properties after baking | |
| | Yield strength (kgf/mm²) | Yield strength (kgf/mm²) | Tensile strength (kgf/mm²) | Elongation (%) | CCV (mm) | Yield strength (kgf/mm²) | *Bake hardening (kgf/mm²) |
| Present Invention | | | | | | | |
| A' | 8.2 | 8.4 | 21.7 | 32.9 | 39.9 | 14.3 | 5.9 |
| B' | 8.5 | 8.5 | 22.0 | 32.3 | 40.0 | 14.0 | 5.5 |
| C' | 8.6 | 8.8 | 22.2 | 32.1 | 40.0 | 13.9 | 5.1 |
| D' | 8.0 | 8.1 | 21.3 | 31.9 | 40.0 | 13.5 | 5.4 |
| E' | 8.9 | 9.0 | 22.1 | 32.0 | 40.0 | 14.3 | 5.3 |
| F' | 8.3 | 8.4 | 21.8 | 32.5 | 40.0 | 13.9 | 5.5 |
| G' | 8.5 | 8.5 | 22.1 | 32.8 | 39.9 | 13.6 | 5.1 |
| Comparative example | | | | | | | |
| H' | 6.4 | 6.5 | 19.4 | 21.4 | 41.2 | 8.0 | 1.5 |
| K' | 6.1 | 6.1 | 19.0 | 16.5 | 41.7 | 8.8 | 2.7 |
| L' | 5.6 | 5.6 | 19.2 | 15.3 | 41.9 | 8.3 | 2.7 |
| M' | 7.7 | 7.8 | 21.5 | 23.7 | 41.0 | 10.1 | 2.3 |
| N' | 8.0 | 8.1 | 21.6 | 30.5 | 40.2 | 9.7 | 1.6 |
| O' | 10.9 | 10.9 | 24.6 | 25.9 | 40.9 | 12.8 | 1.9 |
| P' | 11.1 | 11.1 | 25.0 | 25.0 | 41.0 | 12.8 | 1.7 |
| Q' | 8.7 | 8.8 | 22.3 | 26.3 | 40.9 | 10.3 | 1.5 |
| R' | 8.5 | 8.5 | 22.1 | 25.8 | 40.9 | 10.1 | 1.6 |

As shown in Table 8, it was confirmed that the alloy sheets manufactured in conditions A' to G' were slightly lower in bake hardenability than those of A to G, but the value itself was kept high. Further the alloys manufactured in conditions H' to R' were slightly lower in bake hardening than those of H to R.

Example 5

In this example, experiments according to effect of a low temperature heat treatment on natural aging were conducted, using an alloy sheet having chemical composition of No. 1 of Table 1 and manufactured according to condition A' in Table 8, and conventional material No. 33. The results are shown in FIG. 3.

Figure 3:
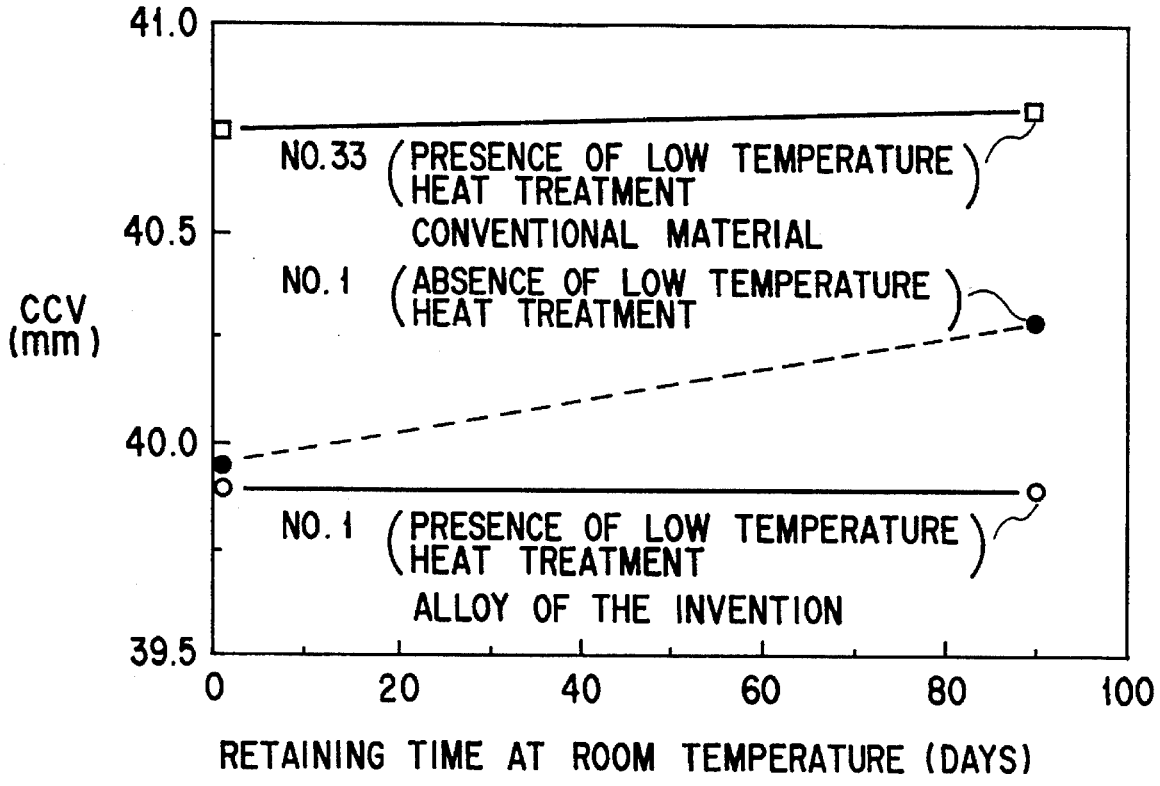
FIG. 3 is a graph showing the effect of a low temperature heat treatment on natural aging retardating property and formability, in No. 1 of example and No. 33 of conventional material.

As apparent from FIG. 3, it was confirmed that the alloy sheet manufactured by the method of the present invention including the low temperature heat treatment had excellent formability and excellent natural aging retardating property.

On the other hand, it was confirmed that the alloy sheet manufactured excluding the low temperature heat treatment showed a low natural aging retardating property and had low formability. Further, conventional material No. 33 had low formability although exhibiting an excellent natural aging retardating property by the low temperature heat treatment.

Example 6

In this example, the effect of limiting the contents of Mg, Cu, and Si to 1.5 to 3.5%, 0.3 to 0.7%, and 0.05 to 0.35%, respectively.

Alloys Nos. 1, 4, and 6 of the above range and Nos. 5 and 7 whose chemical contents were not in the above range were processed to form the sheet of 1 mm in thickness. A heat treatment was conducted using substantially the same conditions as in Example 1.

The sheets were allowed to age at room temperature for one day, and 3 months and 6 months to study of influence of the natural aging after the heat treatment was completed. The tensile test and conical cup test were conducted in substantially the same manner as in Example 1. The results are shown in Table 9.

TABLE 9

| | One day aging after heat treatment | | 3 months aging after heat treatment | | 6 months aging after heat treatment | |
|---|---|---|---|---|---|---|
| Number | Yield strength (kgf/mm$^2$) | CCV (mm) | Yield strength (kgf/mm$^2$) | CCV (mm) | Yield strength (kgf/mm$^2$) | CCV (mm) |
| 1 | 7.5 | 39.9 | 7.8 | 39.9 | 7.9 | 40.0 |
| 4 | 7.2 | 39.9 | 7.3 | 39.9 | 7.3 | 39.9 |
| 6 | 6.5 | 39.8 | 7.0 | 39.9 | 7.2 | 40.0 |
| 5 | 8.0 | 40.1 | 8.2 | 40.1 | 10.7 | 41.2 |
| 7 | 8.9 | 39.9 | 9.4 | 40.0 | 11.3 | 41.0 |

As shown in Table 9, alloys Nos. 1, 4, and 6 of the above range hardly increased in yield strength and exhibited satisfactory CCV even after 6 months aging at room temperature, thereby demonstrating that natural aging was further retarded.

On the other hand, it was confirmed that alloys Nos. 5 and 7, which were not in the above range, increased in yield strength and exhibited low formability after 6 months aging at room temperature, thus significant natural aging occurred, although the alloys hardly changed yield strength and CCV after 3 months aging at room temperature.

Additional advantages and modifications will readily occur to those skilled in the art. Therefore, the invention in its broader aspects is not limited to the specific details, and illustrated examples shown and described herein. Accordingly, various modifications may be made without departing from the spirit or scope of the general inventive concept as defined by the appended claims and their equivalents.

What is claimed is:

1. A method of manufacturing a natural aging-retardated aluminum alloy sheet, said method comprising the steps of:

(a) preparing an aluminum alloy ingot consisting essentially of 1.5 to 3.5% by weight of Mg, 0.3 to 1.0% by weight of Cu, 0.05 to 0.6% by weight of Si, and optionally at least one element selected from the group consisting of 0.03 to 0.50% by weight of Fe, 0.005 to 0.15% by weight of Ti, 0.0002 to 0.05% by weight of B, 0.01 to 0.,50% by weight of Mn, 0.01 to 0.15% by weight of Cr, 0.01 to 0.12% by weight of Zr, 0.01 to 0.18% by weight of V, 0.5 weight % or less of Zn, 0.01to 0.50% by weight of Sn, 0.01 to 0.50% by weight of Cd and 0.01 to 0.50% by weight of In, and a balance of Al, in which the Mg and Cu are in a ratio of Mg/Cu of 2 to 7;

(b) homogenizing the ingot from step (a) in one step or in multiple steps, performed at a temperature of 400° to 580° C.;

(c) preparing an alloy sheet having a desired sheet thickness by subjecting the ingot from step (b) to a hot rolling and a cold rolling;

(d) subjecting the alloy sheet from step (c) to a heat treatment including heating the alloy sheet up to a temperature of 500° to 580° C. at a heating rate of 3° C./second or more, maintaining the alloy sheet for 0 to 60 seconds at the temperature reached, and cooling the alloy sheet to a temperature of 100° C. or less at a cooling rate of 2° C./seconds or more; and (e) heating the alloy sheet from step (d) at a temperature of 180° to 300° C. for 3 to 60 seconds.

2. The method according to claim 1, wherein said aluminium ingot consists essentially of 1.5 to 3.5% by weight of Mg, 0.3 to 0.7% by weight of Cu, 0.05 to 0.35% by weight of Si, and a balance of Al, in which the ratio of Mg/Cu is in the range of 2 to 7.

3. The method according to claim 1, wherein said aluminum alloy ingot is selected from the group consisting of (a) 2.1% by weight of Mg, 0.29% by weight of Si, 0.60% by weight of Cu, 0.14% by weight of Fe, 0.018% by weight of Ti, 0.0017% by weight of B, 0.13% by weight of Zn, <0.01% by weight of Mn, <0.01% by weight of Cr, <0.01% by weight of Zr, <0.01% by weight of V, <0.01% by weight of Sn, <0.01% by weight of In, <0.01% by weight of Cd and the balance Al;

(b) 1.6% by weight of Mg, 0.34% by weight of Si, 0.50% by weight of Cu, 0.14% by weight of Fe, 0.015% by weight of Ti, 0.0016% by weight of B, 0.20% by weight of Zn, <0.01% by weight of Mn, <0.01% by weight of Cr, <0.01% by weight of Zr, <0.01% by weight of V, <0.01% by weight of Sn, <0.01% by weight of In, <0.01% by weight of Cd and the balance Al;

(c) 3.3% by weight of Mg, 0.31% by weight of Si, 0.56% by weight of Cu, 0.12% by weight of Fe, 0.011% by weight of Ti, 0.0011% by weight of B, 0.09% by weight of Zn, <0.01% by weight of Mn, <0.01% by weight of Cr, <0.01% by weight of Zr, <0.01% by weight of V, <0.01% by weight of Sn, <0.01% by weight of In, <0.01% by weight of Cd and the balance Al;

(d) 2.0% by weight of Mg, 0.09% by weight of Si, 0.61% by weight of Cu, 0.17% by weight of Fe, 0.009% by weight of Ti, 0.0008% by weight of B, 0.12% by weight of Zn, <0.01% by weight of Mn, <0.01% by weight of Cr, <0.01% by weight of Zr, <0.01% by weight of V, <0.01% by weight of Sn, <0.01% by weight of In, <0.01% by weight of Cd and the balance Al;

(e) 2.4% by weight of Mg, 0.55% by weight of Si, 0.40% by weight of Cu, 0.09% by weight of Fe, 0.010% by weight of Ti, 0.0011% by weight of B, 0.07% by weight of Zn, <0.01% by weight of Mn, <0.01% by weight of Cr, <0.01% by weight of Zr, <0.01% by weight of V, <0.01% by weight of Sn, <0.01% by weight of In, <0.01% by weight of Cd and the balance Al;

(f) 2.1% by weight of Mg, 0.26% by weight of Si, 0.35% by weight of Cu, 0.15% by weight of Fe, 0.013% by weight of Ti, 0.0012% by weight of B, 0.16% by weight of Zn, <0.01% by weight of Mn, <0.01% by weight of Cr, <0.01% by weight of Zr, <0.01% by weight of V, <0.01% by weight of Sn, <0.01% by weight of In, <0.01% by weight of Cd and the balance Al;

(g) 1.9% by weight of Mg, 0.28% by weight of Si, 0.90% by weight of Cu, 0.10% by weight of Fe, 0.020% by weight of Ti, 0.0019% by weight of B, 0.08% by weight of Zn, <0.01% by weight of Mn, <0.01% by weight of Cr, <0.01% by weight of Zr, <0.01% by weight of V, <0.01% by weight of Sn, <0.01% by weight of In, <0.01% by weight of Cd and the balance Al;

(h) 2.0% by weight of Mg, 0.30% by weight of Si, 0.62% by weight of Cu, 0.42% by weight of Fe, 0.019% by weight of Ti, 0.0017% by weight of B, 0.11% by weight of Zn, <0.01% by weight of Mn, <0.01% by weight of Cr, <0.01% by weight of Zr, <0.01% by weight of V, <0.01% by weight of Sn, <0.01% by weight of In, <0.01% by weight of Cd and the balance Al;

(i) 2.2% by weight of Mg, 0.33% by weight of Si, 0.59% by weight of Cu, 0.13% by weight of Fe, 0.120% by weight of Ti, 0.0460% by weight of B, 0.14% by weight of Zn, <0.01% by weight of Mn, <0.01% by weight of Cr, <0.01% by weight of Zr, <0.01% by weight of V, <0.01% by weight of Sn, <0.01% by weight of In, <0.01% by weight of Cd and the balance Al;

(j) 1.8% by weight of Mg, 0.27% by weight of Si, 0.66% by weight of Cu, 0.09% by weight of Fe, 0.018% by weight of Ti, 0.0018% by weight of B, 0.40% by weight of Zn, <0.01% by weight of Mn, <0.01% by weight of Cr, <0.01% by weight of Zr, <0.01% by weight of V, <0.01% by weight of Sn, <0.01% by weight of In, <0.01% by weight of Cd and the balance Al;

(k) 2.3% by weight of Mg, 0.30% by weight of Si, 0.46% by weight of Cu, 0.12% by weight of Fe, 0.019% by weight of Ti, 0.0018% by weight of B, 0.09% by weight of Zn, 0.43% by weight of Mn, <0.01% by weight of Cr, <0.01% by weight of Zr, <0.01% by weight of V, <0.01% by weight of Sn, <0.01% by weight of In, <0.01% by weight of Cd and the balance Al;

(l) 2.2% by weight of Mg, 0.30% by weight of Si, 0.58% by weight of Cu, 0.10% by weight of Fe, 0.016% by weight of Ti, 0.0014% by weight of B, 0.12% by weight of Zn, <0.01% by weight of Mn, 0.13% by weight of Cr, <0.01% by weight of Zr, <0.01% by weight of V, <0.01% by weight of Sn, <0.01% by weight of In, <0.01% by weight of Cd and the balance Al;

(m) 2.0% by weight of Mg, 0.29% by weight of Si, 0.59% by weight of Cu, 0.09% by weight of Fe, 0.014% by weight of Ti, 0.0011% by weight of B, 0.10% by weight of Zn, <0.01% by weight of Mn, <0.01% by weight of Cr, 0.10% by weight of Zr, <0.01% by weight of V, <0.01% by weight of Sn, <0.01% by weight of In, <0.01% by weight of Cd and the balance Al;

(n) 2.0% by weight of Mg, 0.32% by weight of Si, 0.61% by weight of Cu, 0.11% by weight of Fe, 0.018% by weight of Ti, 0.0017% by weight of B, 0.10% by weight of Zn, <0.01% by weight of Mn, <0.01% by weight of Cr, <0.01% by weight of Zr, 0.16% by weight of V, <0.01% by weight of Sn, <0.01% by weight of In, <0.01% by weight of Cd and the balance Al;

(o) 2.3% by weight of Mg, 0.32% by weight of Si, 0.50% by weight of Cu, 0.10% by weight of Fe, 0.019% by weight of Ti, 0.0018% by weight of B, 0.08% by weight of Zn, <0.01% by weight of Mn, <0.01% by weight of Cr, <0.01% by weight of Zr, 0.01% by weight of V, 0.42% by weight of Sn, <0.01% by weight of In, <0.01% by weight of Cd and the balance Al; and (p) 2.0% by weight of Mg, 0.30% by weight of Si, 0.62% by weight of Cu, 0.12% by weight of Fe, 0.016% by weight of Ti, 0.0014% by weight of B, 0.12% by weight of Zn, <0.01% by weight of Mn, <0.01% by weight of Cr, <0.01% by weight of Zr, <0.01% by weight of V, <0.01% by weight of Sn, 0.39% by weight of In, 0.41% by weight of Cd and the balance Al.

4. A method of manufacturing a natural aging-retardated aluminum alloy sheet, said method comprising the steps of;

(a) preparing an aluminum alloy ingot consisting essentially of 1.5 to 3.5% by weight of Mg, 0.3 to 1.0% by weight of Cu, 0.05 to 0.6% by weight of Si, and optionally at least one element selected from the group consisting of 0.03 to 0.50% by weight of Fe, 0.005 to 0.15% by weight of Ti, 0.0002 to 0.05% by weight of B, 0.01 to 0.50% by weight of Mn, 0.01 to 0.15% by weight of Cr, 0.01 to 0.12% by weight of Zr, 0.01 to 0.18% by weight of V, 0.5 weight % or less of Zn, 0.01 to 0.50% by weight of Sn, 0.01 to 0.50% by weight of Cd and 0.01 to 0.50% by weight of Ink and a balance of Al, in which the Mg and Cu are in a ratio of Mg/Cu of 2 to 7;

(b) homogenizing the ingot from step (a) in one step or in multiple steps at a temperature of 400° to 580° C.;

(c) subjecting the ingot from step (b) to a hot rolling and a cold rolling or a hot rolling only, to form an alloy sheet stock;

(d) subjecting the alloy sheet stock from step (c) to an intermediate annealing treatment including heating the alloy sheet stock up to a temperature of 500° to 580° C. at a heating rate of 3° C./second or more, maintaining the alloy sheet stock for 0 to 60 seconds at the temperature reached, and cooling the alloy sheet stock to 100° C. at a cooling rate of 2° C./seconds or more;

(e) preparing an alloy sheet having a desired thickness by subjecting the alloy sheet stock from step (d) to a cold rolling treatment at a cooling reduction of 5 to 45%;

(f) subjecting the alloy sheet from step (e) to a heat treatment including steps of heating the alloy sheet up to a temperature of 500° to 580° C. at a heating rate of 3° C./second or more, maintaining the alloy sheet at the temperature reached for 0 to 60 seconds, and cooling the alloy sheet to 100° C. or less at a cooling rate of 2° C./seconds or more; and (g) heating the alloy sheet from step (f) at a temperature of 180° to 300° C. for 3 to 60 seconds.

5. The method according to claim 4, wherein said aluminum ingot consists essentially of 1.5 to 3.5% by weight of Mg, 0.3 to 0.7% by weight of Cu, 0.05 to 0.35% by weight of Si, and a balance of Al, in which the ratio of Mg/Cu is in the range of 2 to 7.

6. The method according to claim 4, wherein said aluminum alloy ingot is selected from the group consisting of (a) 2.1% by weight of Mg, 0.29% by weight of Si, 0.60% by weight of Cu, 0.14% by weight of Fe, 0.018% by weight of Ti, 0.0017% by weight of B, 0.13% by weight of Zn, <0.01% by weight of Mn, <0.01% by weight of Cr, <0.01% by weight of Zr, <0.01% by weight of V, <0.01% by weight of Sn, <0.01% by weight of In, <0.01% by weight of Cd and the balance Al;

(b) 1.6% by weight of Mg, 0.34% by weight of Si, 0.50% by weight of Cu, 0.14% by weight of Fe, 0.015% by weight of Ti, 0.0016% by weight of B, 0.20% by weight of Zn, <0.01% by weight of Mn, <0.01% by weight of Cr, <0.01% by weight of Zr, <0.01% by weight of V, <0.01% by weight of Sn, <0.01% by weight of In, <0.01% by weight of Cd and the balance Al;

(c) 3.3% by weight of Mg, 0.31% by weight of Si, 0.56% by weight of Cu, 0.12% by weight of Fe, 0.011% by weight of Ti, 0.0011% by weight of B, 0.09% by weight of Zn, <0.01% by weight of Mn, <0.01% by weight of Cr, <0.01% by weight of Zr, <0.01% by weight of V, <0.01% by weight of Sn, <0.01% by weight of In, <0.01% by weight of Cd and the balance Al;

(d) 2.0% by weight of Mg, 0.09% by weight of Si, 0.61% by weight of Cu, 0.17% by weight of Fe, 0.009% by weight of Ti, 0.0008% by weight of B, 0.12% by weight of Zn, <0.01% by weight of Mn, <0.01% by weight of Cr, <0.01% by weight of Zr, <0.01% by weight of V, <0.01% by weight of Sn, <0.01% by weight of In, <0.01% by weight of Cd and the balance Al;

(e) 2.4% by weight of Mg, 0.55% by weight of Si, 0.40% by weight of Cu, 0.09% by weight of Fe, 0.010% by weight of Ti, 0.0011% by weight of B, 0.07% by weight of Zn, <0.01% by weight of Mn, <0.01% by weight of Cr, <0.01% by weight of Zr, <0.01% by weight of V, <0.01% by weight of Sn, <0.01% by weight of In, <0.01% by weight of Cd and the balance Al;

(f) 2.1% by weight of Mg, 0.26% by weight of Si, 0.35% by weight of Cu, 0.15% by weight of Fe, 0.013% by weight of Ti, 0.0012% by weight of B, 0.16% by weight of Zn, <0.01% by weight of Mn, <0.01% by weight of Cr, <0.01% by weight of Zr, <0.01% by weight of V, <0.01% by weight of Sn, <0.01% by weight of In, <0.01% by weight of Cd and the balance Al;

(g) 1.9% by weight of Mg, 0.28% by weight of Si, 0.90% by weight of Cu, 0.10% by weight of Fe, 0.020% by weight of Ti, 0.0019% by weight of B, 0.08% by weight of Zn, <0.01% by weight of Mn, <0.01% by weight of Cr, <0.01% by weight of Zr, <0.01% by weight of V, <0.01% by weight of Sn, <0.01% by weight of In, <0.01% by weight of Cd and the balance Al;

(h) 2.0% by weight of Mg, 0.30% by weight of Si, 0.62% by weight of Cu, 0.42% by weight of Fe, 0.019% by weight of Ti, 0.0017% by weight of B, 0.11% by weight of Zn, <0.01% by weight of Mn, <0.01% by weight of Cr, <0.01% by weight of Zr, <0.01% by weight of V, <0.01% by weight of Sn, <0.01% by weight of In, <0.01% by weight of Cd and the balance Al;

(i) 2.2% by weight of Mg, 0.33% by weight of Si, 0.59% by weight of Cu, 0.13% by weight of Fe, 0.120% by weight of Ti, 0.0460% by weight of B, 0.14% by weight of Zn, <0.01% by weight of Mn, <0.01% by weight of Cr, <0.01% by weight of Zr, <0.01% by weight of V, <0.01% by weight of Sn, <0.01% by weight of In, <0.01% .by weight of Cd and the balance Al;

(j) 1.8% by weight of Mg, 0.27% by weight of Si, 0.66% by weight of Cu, 0.09% by weight of Fe, 0.018% by weight of Ti, 0.0018% by weight of B, 0.40% by weight of Zn, <0.01% by weight of Mn, <0.01% by weight of Cr, <0.01% by weight of Zr, <0.01% by weight of V, <0.01% by weight of Sn, <0.01% by weight of In, <0.01% by weight of Cd and the balance Al;

(k) 2.3% by weight of Mg, 0.30% by weight of Si, 0.46% by weight of Cu, 0.12% by weight of Fe, 0.019% by weight of Ti, 0.0018% by weight of B, 0.09% by weight of Zn, 0.43% by weight of Mn, <0.01% by weight of Cr, <0.01% by weight of Zr, <0.01% by weight of V, <0.01% by weight of Sn, <0.01% by weight of In, <0.01 by weight of Cd and the balance Al;

(l) 2.2% by weight of Mg, 0.30% by weight of Si, 0.58% by weight of Cu, 0.10% by weight of Fe, 0.016% by weight of Ti, 0.0014by weight of B, 0.12% by weight of Zn, <0.01% by weight of Mn, 0.13% by weight of Cr, <0.01% by weight of Zr, <0.01% by weight of V, <0.01% by weight of Sn, <0.01% by weight of In, <0.01% by weight of Cd and the balance Al;

(m) 2.0% by weight of Mg, 0.29% by weight of Si, 0.59% by weight of Cu, 0.09% by weight of Fe, 0.014% by weight of Ti, 0.0011% by weight of B, 0.10% by weight of Zn, <0.01% by weight of Mn, <0.01% by weight of Cr, 0.10% by weight of Zr, <0.01% by weight of V, <0.01% by weight of Sn, <0.01% by weight of In, <0.01% by weight of Cd and the balance Al;

(n) 2.0% by weight of Mg, 0.32% by weight of Si, 0.61% by weight of Cu, 0.11% by weight of Fe, 0.018% by weight of Ti, 0.0017% by weight of B, 0.10% by weight of Zn, <0.01% by weight of Mn, <0.01% by weight of Cr, <0.01% by weight of Zr, 0.16% by weight of V, <0.01% by weight of Sn, <0.01% by weight of In, <0.01% by weight of Cd and the balance Al;

(o) 2.3% by weight of Mg, 0.32% by weight of Si, 0.50% by weight of Cu, 0.10% by weight of Fe, 0.019% by weight of Ti, 0.0018% by weight of B, 0.08% by weight of Zn, <0.01% by weight of Mn, <00.01% by weight of Cr, <0.01% by weight of Zr, 0.16% by weight of V, 0.42% by weight of Sn, <0.01% by weight of In, <0.01% by weight of Cd and the balance Al; and (p) 2.0% by weight of Mg, 0.30% by weight of Si, 0.62% by weight of Cu, 0.12% by weight of Fe, 0.016% by weight of Ti, 0.0014% by weight of B, 0.12% by weight of Zn, <0.01% by weight of Mn, <0.01% by weight of Cr, <0.01% by weight of Zr, <0.01% by weight of V, <0.01% by weight of Sn, <0.39% by weight of In, 0.41% by weight of Cd and the balance Al.

* * * * *